US010794008B2

(12) United States Patent
Rodrigues

(10) Patent No.: US 10,794,008 B2
(45) Date of Patent: Oct. 6, 2020

(54) ELECTRIC-HYDRAULIC RAILWAY SWITCH DEVICE FOR MOVING RAILROAD SWITCH POINTS

(71) Applicant: Dilson dos Santos Rodrigues, Robinson, TX (US)

(72) Inventor: Dilson dos Santos Rodrigues, Robinson, TX (US)

( * ) Notice: Subject to any disclaimer, the term of this patent is extended or adjusted under 35 U.S.C. 154(b) by 216 days.

(21) Appl. No.: 15/499,890

(22) Filed: Apr. 28, 2017

(65) Prior Publication Data

US 2018/0073198 A1 Mar. 15, 2018

Related U.S. Application Data

(63) Continuation-in-part of application No. 15/262,908, filed on Sep. 12, 2016, now abandoned.

(51) Int. Cl.

| | |
|---|---|
| ***E01B 7/00*** | (2006.01) |
| ***F15B 11/16*** | (2006.01) |
| ***F15B 15/26*** | (2006.01) |
| ***F15B 20/00*** | (2006.01) |

(52) U.S. Cl.

CPC ..... *E01B 7/00* (2013.01); *F15B 11/16* (2013.01); *F15B 15/261* (2013.01); *F15B 20/002* (2013.01); *F15B 2211/6336* (2013.01); *F15B 2211/71* (2013.01); *F15B 2211/72* (2013.01)

(58) Field of Classification Search

CPC .... B61L 5/045; B61L 5/10; B61L 5/04; B61L 5/065; B61L 5/02; B61L 5/00; E01B 7/00; E01B 2202/08; F15B 11/16; F15B 15/261; F15B 20/002; F15B 2211/6336; F15B 2211/71; F15B 2211/72

See application file for complete search history.

(56) References Cited

U.S. PATENT DOCUMENTS 801,440 A * 10/1905 Coleman ..... B61L 5/04 246/158
3,363,097 A * 1/1968 Wilhelm ..... B61L 23/002 246/393
5,375,796 A * 12/1994 Turner ..... B61L 5/04 246/257
5,417,392 A * 5/1995 Wyatt ..... B61L 5/04 246/257
5,775,647 A * 7/1998 Wyatt ..... B61L 5/045 246/258

(Continued)

*Primary Examiner* — Mark T Le
(74) *Attorney, Agent, or Firm* — Thrasher Associates

(57) ABSTRACT

A railroad switch device for moving railroad switch points is provided. The device includes a hydraulic unit comprising a hydraulic manifold, a hydraulic cylinder to provide constant forward movement and reverse movement, and a hydraulic circuit unit. The railroad switch device also includes a mechanical target to automatically indicate the position of a point rod, where the hydraulic unit is coupled to the point rod. Additionally, the railroad switch device includes a plurality of spring units to produce a continuous thrust force for holding the railroad switch points closed in forward position and reverse position, where the plurality of spring units control the target rotation to approximately 90 degrees. A plurality of proximity sensors detect the point rod position, and a power unit supplies hydraulic power to the hydraulic unit for moving the hydraulic cylinder.

11 Claims, 15 Drawing Sheets

(56) References Cited

U.S. PATENT DOCUMENTS

| | | | | |
|---|---|---|---|---|
| 6,168,120 | B1 * | 1/2001 | Pease | B61L 5/00 246/393 |
| 6,270,041 | B1 * | 8/2001 | Helas | B61L 5/10 246/448 |
| 6,578,799 | B1 * | 6/2003 | Brushwood | B61L 5/00 246/220 |
| 2001/0054670 | A1 * | 12/2001 | Franke | B61L 5/107 246/220 |
| 2009/0072097 | A1 * | 3/2009 | Arnold | B61L 5/107 246/220 |
| 2009/0242706 | A1 * | 10/2009 | Mugg | B61L 5/02 246/435 R |

* cited by examiner

ELECTRIC-HYDRAULIC RAILWAY SWITCH DEVICE FOR MOVING RAILROAD SWITCH POINTS

CLAIM OF PRIORITY

The is related to and claims priority from U.S. patent application Ser. No. 15/262,908 filed on Sep. 12, 2016, by Dilson dos Santos Rodrigues, entitled RAILWAY SWITCH DEVICE FOR MOVING RAILROAD SWITCH POINTS.

TECHNICAL FIELD

The present invention generally relates to a railroad infrastructure, and more particularly relates to a hydraulic railroad switch device.

BACKGROUND

Railway track switches are mechanical devices that can change a train's course from one track to another. A typical rail track junction comprises two or more tracks that merge together or form a crossover to lead a train from one track to another. A track junction usually has a straight track and a diverging track toward the left hand side or the right hand side of the straight track. Based on their setup, the tracks are named left diverging track or right diverging track. The rail tracks that form a junction have three types of rails that form the whole junction. The first is the stock rail, which is a permanent rail that does not undergo any movement and extends from the junction to the length of the track. The second type of rail is an intermediary rail, known as closure rail, which is stationary in nature and does not undergo any movement when the train's course is switched.

The closure rails form the overlap between two different train tracks. In a track junction comprising a straight track and a right diverging track, the closure rail of the straight track passes into the path of the right diverging track and the closure rail of the right diverging track passes into the path of the straight track. Thus, the two tracks merge to form a common track. The actual track switching is achieved with the third track, the switch rail, which is movable in nature. The switch rail terminates to form a tapering end and the ends can merge with one of the straight and the diverging tracks when they are moved in the lateral direction.

The switch rails are moved using a track switching machine. The machine is usually hydraulically or pneumatically operated. The machine has a switch rod that leads to the movable switch rails. When the tracks have to be aligned between the straight track and the diverging track, the switch rod is reciprocated in a lateral direction to attain a lateral shift of the switch rails. The lateral shift of the switch rails creates a shift between the two tracks. Conventional track switch machines were operated by an operator manually every time when trains had to change their course between two different tracks. Over the years, track switching machines have evolved to incorporate hydraulic or pneumatic power systems that are remotely controlled by an operator, where the tracks are switched without the presence of the operator at the site. Remote-controlled track switching systems also incorporate manual override provisions for enabling an operator to rectify track switching problems due to factors such as loss of effective communication between the remote operator and the track switch or malfunction of electrical components that control the hydraulic or pneumatic elements.

Hydraulic railway switch have been utilized on railroads to move the rail points. Numerous switches use one or two springs to allow the train to run through a switch without damaging its components, but none of the existing switches presented an effective solution to avoid the switch from moving due to the spring force generated during manual installation or maintenance.

Existing hydraulic switches do not present a reliable point detection & indication system or hand throw operation, with the lack of electric power energy. Furthermore, during manual operation, the state-of-the-art track switches are ineffective in terms of operator safety and could cause physical harm to operators, leading to injuries or death.

In view of the foregoing, there is need for a hydraulic railroad switch device to detect a reliable switch point and enable a hand throw operation without electric power energy.

Further limitations and disadvantages of conventional and traditional approaches will become apparent to one of skill in the art through comparison of described systems with some aspects of the present disclosure, as set forth in the remainder of the present application and with reference to the drawings.

DISCUSSION OF RELATED ART

State-of-the-art track switching machines are operated hydraulically or pneumatically. The machines are usually controlled by an operator who sits at a control room located at a remote location from the tracks. The machines also have a manual operation lever that can be actuated for manual shift of the tracks in case of a hydraulic or pneumatic circuit failure.

US2011049308A1 of Beaman et al. is related to a hydraulically operated track switching machine. Beaman et al. consists of a switch connector rod connected to switch rails of a railway track and the movement of the switch rails is effected by the reciprocating movement of the switch connector rod. The device also has a target that signals the current status of the tracks. According to Beaman et al., the switch rails are urged to the stock rails by the spring force produced from the springs present in the track switching machine.

U.S. Pat. No. 4,213,588A of Bowles is related to a track switch machine, which is fluidically operated by hydraulic or pneumatic means. The machine has lock members that can lock the rail points in two extreme positions. In Bowles, spring action is used for effecting movement of the rail points from at least one extreme position to another. However, the U.S. Pat. No. 4,213,588A does not talk about a mechanism for preventing accidental movement of the switch rails caused by operator error during maintenance. When a track switch machine is operated by manual override lever, the switch rails may undergo undesired movement due to spring force or power circuit malfunctions. Hence, an effective lock mechanism is required to lock the switch rails at a position that is not of any harm to the operator.

Various embodiments of the present invention target the abovementioned requirements and others related thereto.

SUMMARY OF THE INVENTION

A hydraulic railroad switch device for moving railroad switch points are provided substantially as shown in, and/or described in connection with, at least one of the figures, as set forth more completely in the claims.

According to embodiments illustrated herein, there is provided a hydraulic railway switch device for moving railroad switch points. The device includes a trailable switching unit, a throw unit, a hydraulic unit, a center stroke unit, a mechanical target, plurality of spring units, plurality of proximity sensors, and a power unit.

The trailable switching unit enables a train to run through the trailable switching unit. In one embodiment, the trailable switching unit may be controlled through at least one of: a local PLC, and a remote PLC. The throw unit automatically adjusts the plurality of rail and throw distances. The hydraulic unit includes a hydraulic manifold, plurality of hydraulic cylinders, and a hydraulic circuit unit. The hydraulic cylinder provides constant forward and reverse movement. The hydraulic circuit unit increases the operation period.

The center stroke unit blocks the hydraulic cylinder movement at the middle stroke during installation and maintenance. The mechanical target automatically indicates the position of a point rod. In one embodiment, the hydraulic unit is directly connected to the point rod without intermediate components.

The spring unit produces a continuous thrust force to hold the railroad switch points closed when in forward position and reverse position, wherein the plurality of spring units are installed at a target shaft to control the target rotation to 90 degrees through a bolt configured with a rotation limit ring. The proximity sensors detects the point rod position and adjusts the point rod. The power unit supplies the hydraulic power to the hydraulic unit to move the hydraulic cylinder.

These and other features and advantages of the present disclosure may be appreciated by a review of the following detailed description of the present disclosure, along with the accompanying figures in which like reference numerals refer to like parts throughout.

BRIEF DESCRIPTION OF DRAWINGS

The accompanying drawings illustrate the various embodiments of systems, methods, and other aspects of the disclosure. Any person with ordinary skills in the art will appreciate that the illustrated element boundaries (e.g., boxes, groups of boxes, or other shapes) in the figures represent one example of the boundaries. In some examples, one element may be designed as multiple elements, or multiple elements may be designed as one element. In some examples, an element shown as an internal component of one element may be implemented as an external component in another, and vice versa. Furthermore, the elements may not be drawn to scale.

Various embodiments will hereinafter be described in accordance with the appended drawings, which are provided to illustrate and not to limit the scope in any manner, wherein similar designations denote similar elements, and in which.

DETAILED DESCRIPTION

Figure 1:
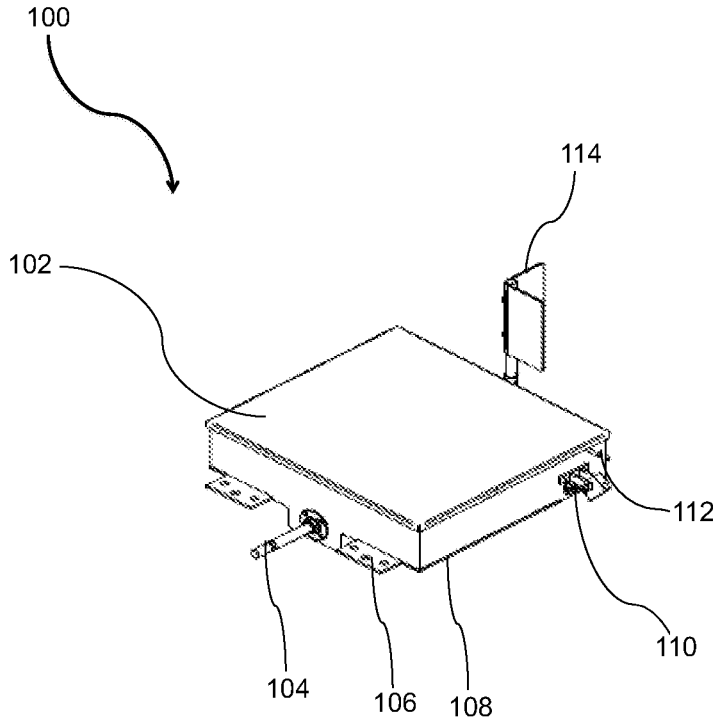
FIG. 1 illustrates the first general view of the trailable switching unit, in accordance with at least one embodiment.

The present disclosure is best understood with reference to the detailed figures and description set forth herein. Various embodiments are discussed below with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment", "at least one embodiment", "an embodiment", "one example", "an example", "for example", and so on indicate that the embodiment(s) or example(s) may include a particular feature, structure, characteristic, property, element, or limitation, but not every embodiment or example necessarily includes that particular feature, structure, characteristic, property, element, or limitation. Furthermore, repeated use of the phrase "in an embodiment" does not necessarily refer to the same embodiment.

Unless defined otherwise, all technical and scientific terms used herein have the same meaning as commonly understood by one of ordinary skill in the art to which this invention belongs. Although any method and material similar or equivalent to those described herein can also be used in the practice or testing of the present invention, the preferred methods and materials are described and are incorporated within the scope of the claims. All publications, patents, and patent applications mentioned herein are incorporated in their entirety.

It is also noted that as used herein and in the appended claims, the singular forms "a", "and", and "the" include plural referents unless the context clearly dictates otherwise. In the claims, the terms "first", "second", and so forth are to be interpreted merely as ordinal designations they shall not be limited in themselves. Furthermore, the use of exclusive terminology such as "solely", "only" and the like in connection with the recitation of any claim element is contemplated. It is also contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

All references, including publications, patent applications, and patents cited herein are hereby incorporated by reference to the same extent as if each reference were individually and specifically indicated to be incorporated by reference and were set forth in its entirety herein.

The recitation of ranges of values herein are merely intended to serve as a shorthand method of referring individually to each separate value falling within the range, unless otherwise indicated herein, and each separate value is incorporated into the specification as if it were individually recited herein.

The hydraulic railway switch device for moving railroad switch points includes a trailable switching unit (explained in detail in conjunction with FIGS. 1 and 2), a throw unit, a hydraulic unit, a center stroke unit, a mechanical target, plurality of spring units, plurality of proximity sensors, a power unit, a top rod bracket, a center bracket, a cam follower bearing, a hand throw pump, a block clamp, a control shaft, a safety latch, at least two separated centering block, a sensor target, a front flange, bushing, a hand throw socket, and a hydraulic directional valve.

Figure 2:
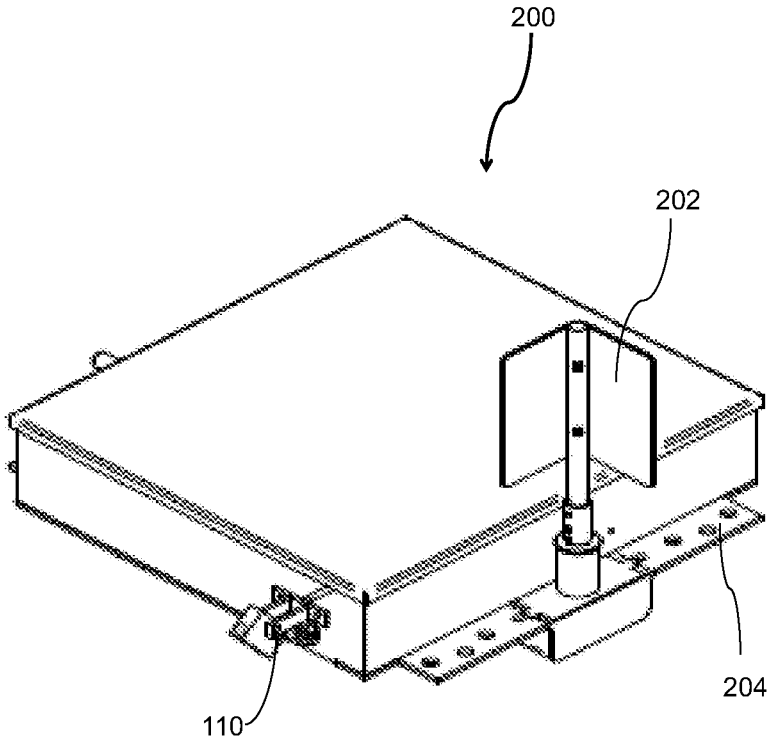
FIG. 2 illustrates the second general view of the trailable switching unit, in accordance with at least one embodiment.

FIG. 1 illustrates the first general view 100 of the trailable switching unit, in accordance with at least one embodiment. FIG. 2 illustrates the second general view 200 of the trailable switching unit, in accordance with at least one embodiment. The trailable switching unit enables a train to run through the trailable switching unit.

In one embodiment, the trailable switching unit may be controlled through at least one of: a local PLC, and a remote PLC. The PLC is used to control and monitor input signals from various input sensors, which report events and conditions occurring in a controlled process such as power on/off or emergency cut-off of the trailable switching unit. The voltages handled by the trailable switching unit tends to be relatively high. Furthermore, the voltages handled by the trailable switching unit may be direct current (DC) or alternating current (AC). However, the electronic components of the PLC typically operate at much lower DC voltages, e.g., 3.3-5 volts.

In an embodiment, the local and remote programmable logic controller (PLC) used in the present invention are digital computer used for the automation of electromechanical processes, such as control of machinery on factory assembly lines, or light fixtures. The aforementioned PLCs are designed for multiple inputs and output arrangements, extended temperature ranges, immunity to electrical noise, and resistance to vibration and impact. Programs to control machine operation are typically stored in battery backup or non-volatile memory.

The trailable switching unit includes a switch lid 102, switch operation rod 104, front foot 106, switch housing 108, hand pump operation 110, hand operation direction lever 112, and rear target 114 or mechanical target (mechanical rod position indication). The switch housing 108 includes a top surface that is switch lid 102 and secures switch operation rod 104, front foot 106, hand pump operation 110, hand operation direction lever 112, and rear target 114.

The second general view 200 of the trailable switching unit includes a target mast 202, a rear foot 204, and a hand pump operation 110. The mechanical target 114 automatically indicates the position of a point rod. In one embodiment, the hydraulic unit is directly connected to the point rod without intermediate components.

Figure 3:
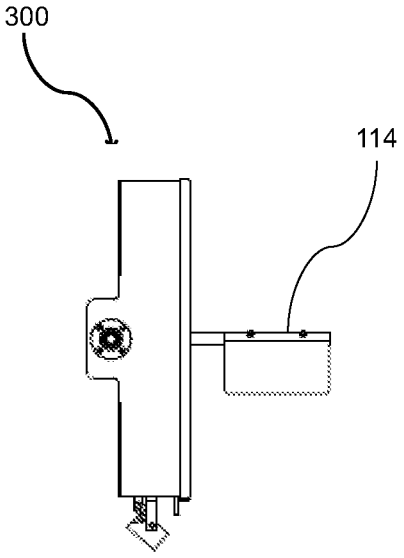
FIG. 3 illustrates the front view of the trailable switching unit, in accordance with at least one embodiment.
Figure 4:
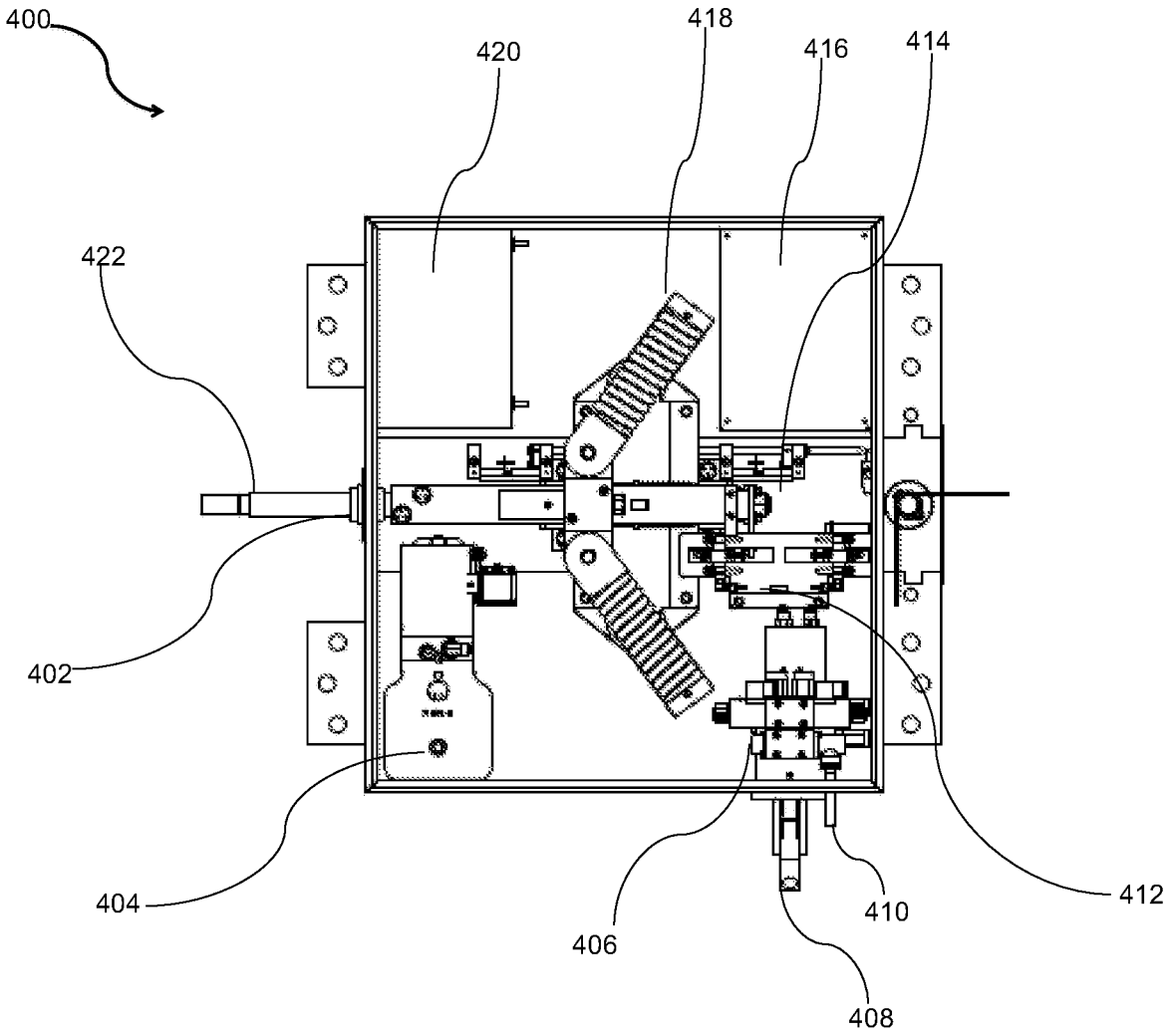
FIG. 4 illustrates the top view of the trailable switching unit, in accordance with at least one embodiment.

FIG. 3 illustrates the front view 300 of the trailable switching unit, in accordance with at least one embodiment. FIG. 4 illustrates the top view 400 of the trailable switching unit, in accordance with at least one embodiment. The top view 400 of the trailable switching unit shows the front flange and bushing 402. The front flange 402 and bushing avoids the rod to bend under the stress caused by the train running through the trailable switching unit.

The top view 400 of the trailable switching unit further shows the hydraulic unit, the power unit 404, hydraulic manifold 406, hand pump and socket 408, a hand throw pump 410, the proximity sensors and bracket 412, the center stroke unit 414, electric and electronic shelf 416, the spring unit 418, and a battery 420. The hydraulic unit includes a hydraulic manifold 406, plurality of hydraulic cylinders 422, and a hydraulic circuit unit defined by the totality of items fluidly coupled. The hydraulic cylinder 422 provides constant forward movement and reverse movement to define an operation cycle, and in time an operation period. The hydraulic circuit unit increases the operation period.

The center stroke unit 414 to block the hydraulic cylinder movement at middle stroke during installation and maintenance. The spring unit 418 produces a continuous thrust force to hold the railroad switch points closed when in forward position and reverse position. In one embodiment, the plurality of spring unit 418 installed at a target shaft to control the target rotation to 90 degrees through a bolt configured with a rotation limit ring.

Figure 5:
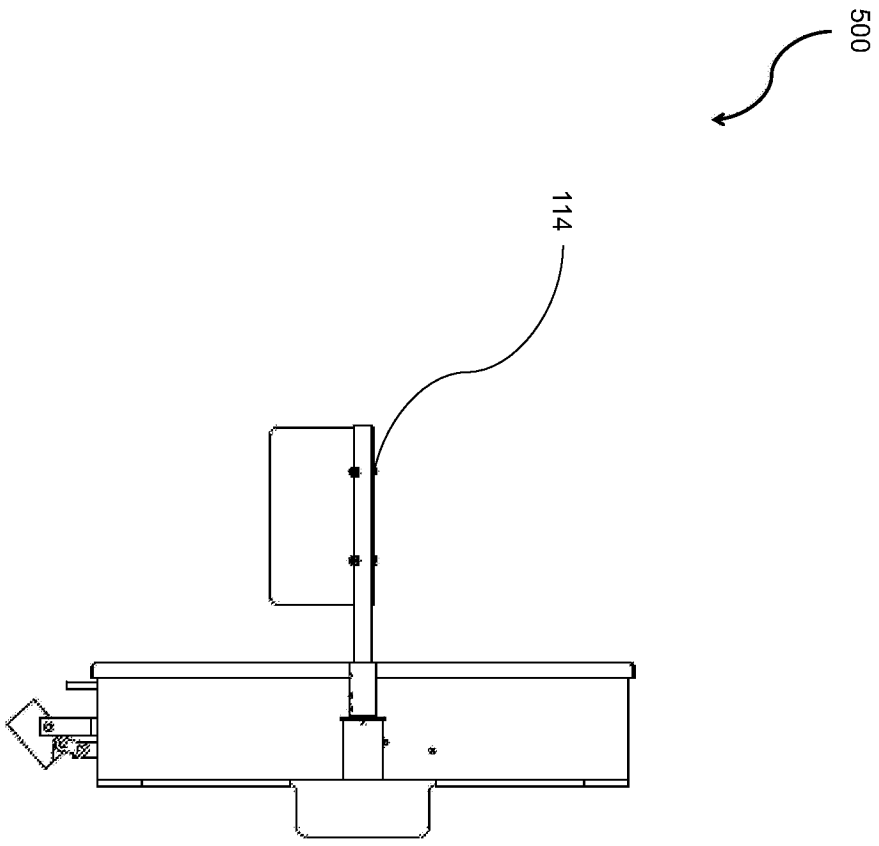
FIG. 5 illustrates the rear view of the trailable switching unit, in accordance with at least one embodiment.

The proximity sensors 412 detects the point rod position and further adjusts the point rod. The power unit 404 supplies the hydraulic power to the hydraulic unit to move the hydraulic cylinder 422. The power unit 404 is selected from a DC battery source or AC power source. FIG. 5 illustrates the rear view 500 of the trailable switching unit, in accordance with at least one embodiment.

Figure 6:
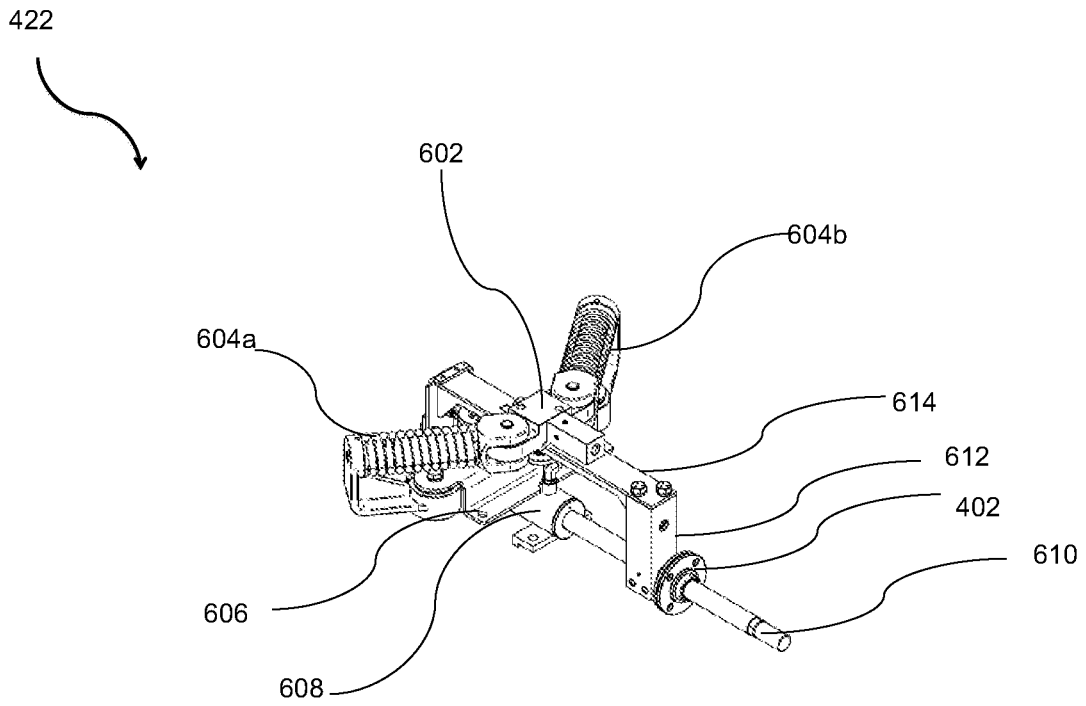
FIG. 6 illustrates the operation of hydraulic cylinder, in accordance with at least one embodiment.

FIG. 6 illustrates the operation of hydraulic cylinder 422, in accordance with at least one embodiment. The hydraulic cylinder 422 includes a spring pivot bar 602, plurality of compressed springs 604, a bearing guide bracket 606, a double rod cylinder 608, a front cylinder rod 610, a flange & bushing 402, a front rod bar 612, a top rod bracket 614, a cam follower bearing (shown and explained in conjunction with FIG. 11), and a center bracket. The cam follower bearing installed under the top rod bracket runs inside the centering bracket roller tray to avoid the rod rotation caused by external forces.

Figure 7:
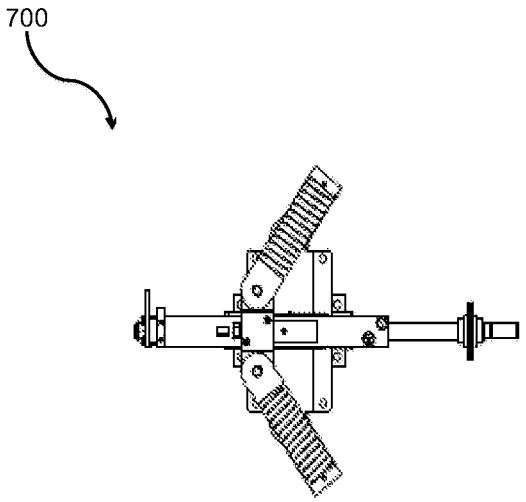
FIG. 7 illustrates the components of hydraulic cylinder, in accordance with at least one embodiment.
Figure 8:
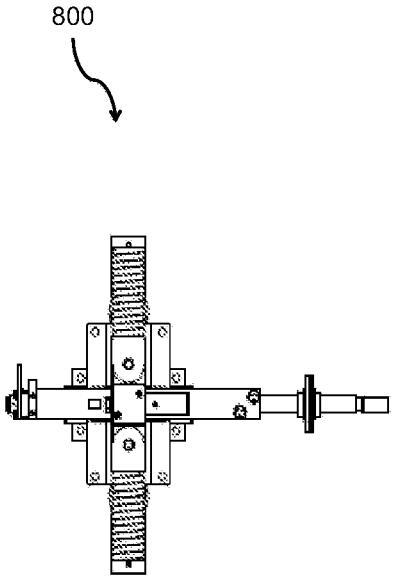
FIG. 8 illustrates the spring unit in the reverse position, in accordance with at least one embodiment.

FIG. 7 illustrates the spring unit in the reverse position 700, in accordance with at least one embodiment. The hydraulic cylinder 422 or switch rod is positioned at the reverse position, the springs are pulling the railroad switch points. FIG. 8 illustrates the spring unit in the center position 800, in accordance with at least one embodiment. When the hydraulic cylinder 422 starts moving, the two springs are compressed until the center stroke position decompresses the rest of remaining movement.

At the center stroke position, the springs are fully compressed and have a great instable potential position. Any small movement or vibration would make the springs to move forward or back. During the installation or maintenance of the switch or the railroad switch points, any inspected switch move may cause injuries or loss of personnel.

Figure 9:
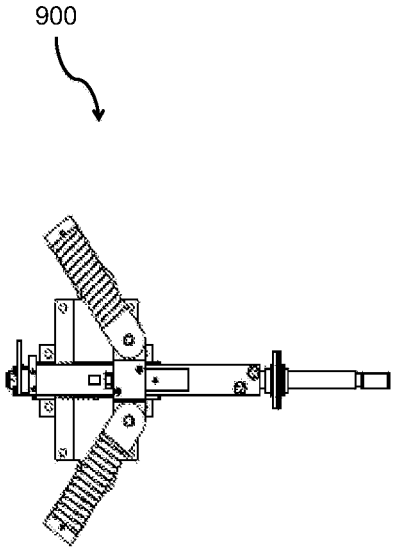
FIG. 9 illustrates the spring unit in the center position, in accordance with at least one embodiment.

FIG. 9 illustrates the spring unit in the forward position 900, in accordance with at least one embodiment. The hydraulic cylinder 422 or switch rod is positioned at a forward position (normal); the springs are pushing the railroad switch points. There is no stroke limit other than the cylinder stroke distance. As the normal point throw distance is lower than the cylinder stroke, the springs will always apply the desired holding force to the points. The spring unit 418 holds the force applied to the railroad switch points to prevent the railroad switch points from stopping correspondence to avoid the train derailment.

After the hydraulic cylinder 422 moves the points from one position to another, the hydraulic power is turned off and the rail points are kept closed by the spring force. If one train runs through the switch, the cylinder will completely move to the other position without damaging the components; there is no hydraulic restriction to the movement.

Figure 10:
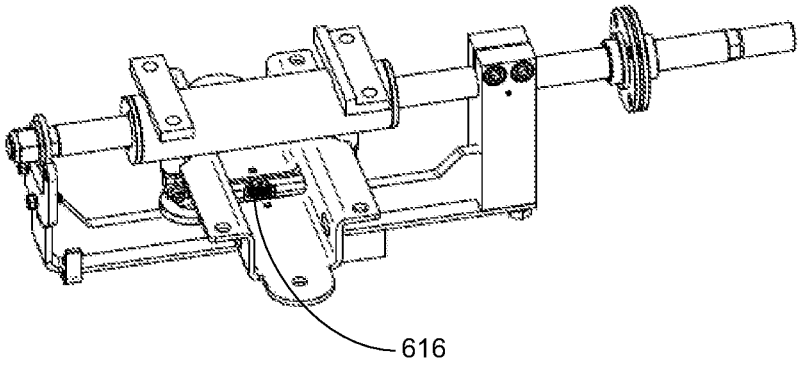
FIG. 10 illustrates the spring unit in the forward position, in accordance with at least one embodiment.

FIG. 10 illustrates the cam follower bearing 616, in accordance with at least one embodiment. The cam follower bearing 616 installed under the top rod bracket runs inside the centering bracket roller tray to avoid the rod rotation caused by external forces. This also allows the use of electronic proximity sensors to detect the rod position with high precision.

Figure 11:
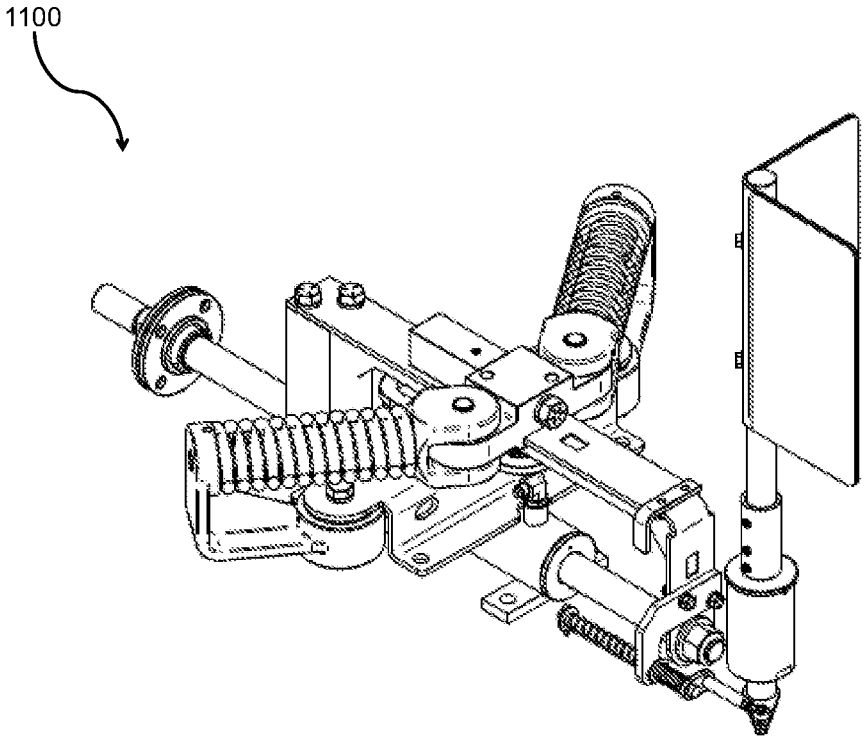
FIG. 11 illustrates the cam follower bearing, in accordance with at least one embodiment.
Figure 12:
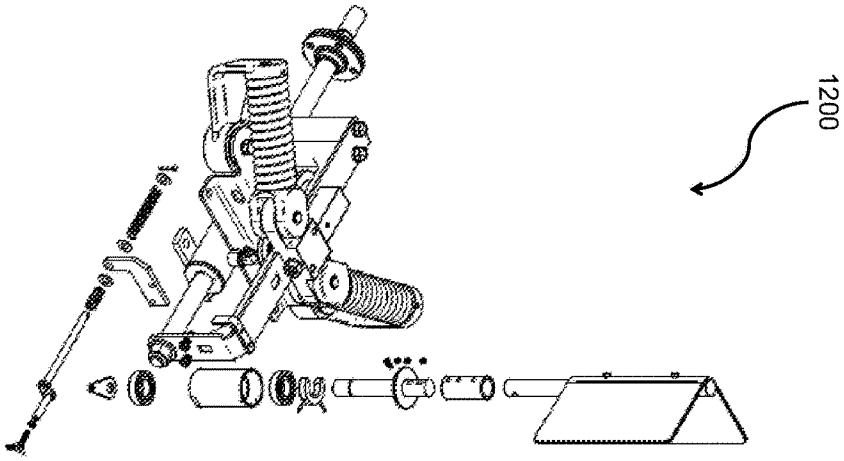
FIG. 12 illustrates the mechanical target operation, in accordance with at least one embodiment.

FIG. 11 illustrates the mechanical target operation 1100, in accordance with at least one embodiment. FIG. 12 illustrates the components 1200 of the mechanical target, in accordance with at least one embodiment. The mechanical target automatically indicates the position of a point rod. In one embodiment, the hydraulic unit is directly connected to the point rod without intermediate components. The mechanical target may show in advance the switch position to the train crew. The mechanical target is controlled by the switch rod movement through the target bracket. The plurality of spring units are installed at a target shaft to control the target rotation to 90 degrees through a bolt configured with a rotation limit ring.

Figure 13:
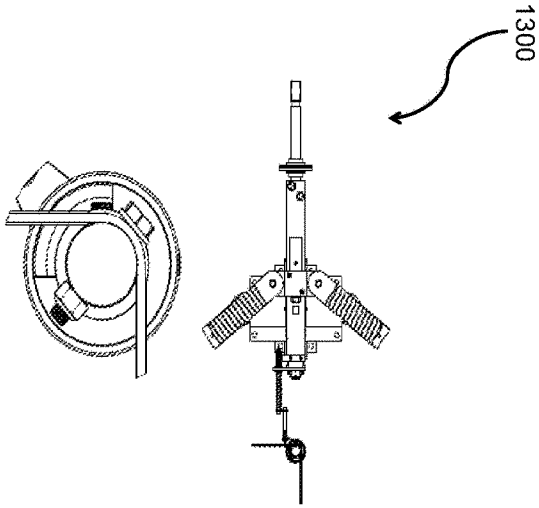
FIG. 13 illustrates the components of the mechanical target, in accordance with at least one embodiment.
Figure 14:
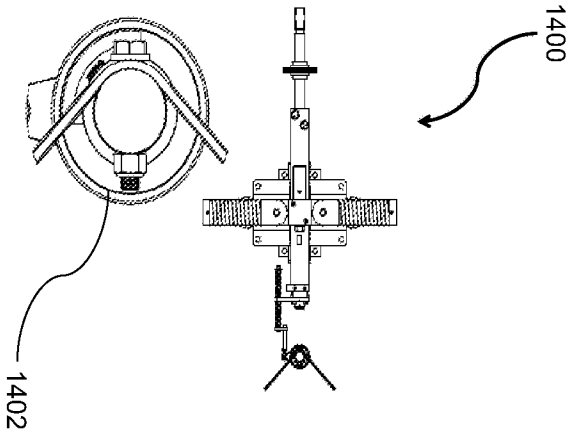
FIG. 14 illustrates the various operations of the rotation limit ring, in accordance with at least one embodiment.
Figure 15:
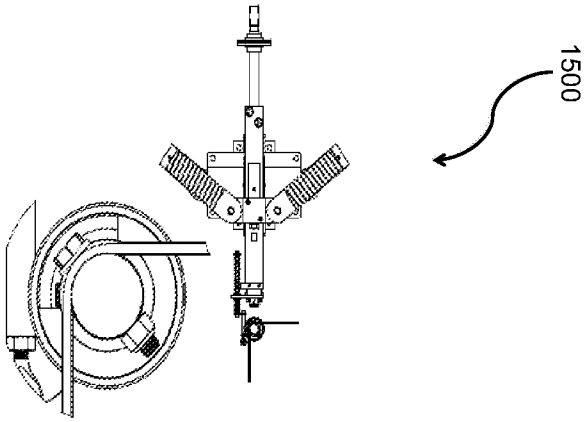
FIG. 15 illustrates the various operations of the rotation limit ring, in accordance with at least one embodiment.

FIGS. 13-15 illustrate the various operations 1300 of the rotation limit ring 1402, in accordance with at least one embodiment. A rotation limit ring 1402 is installed inside the target bearing housing to control the target position. A bolt is used to limit the target rotation; after the limit is reached, one spring is compressed until the end of the rod throw operation maintaining the target in position. The compressed spring will create a holding necessary force to avoid the target movement under external forces.

Figure 16:
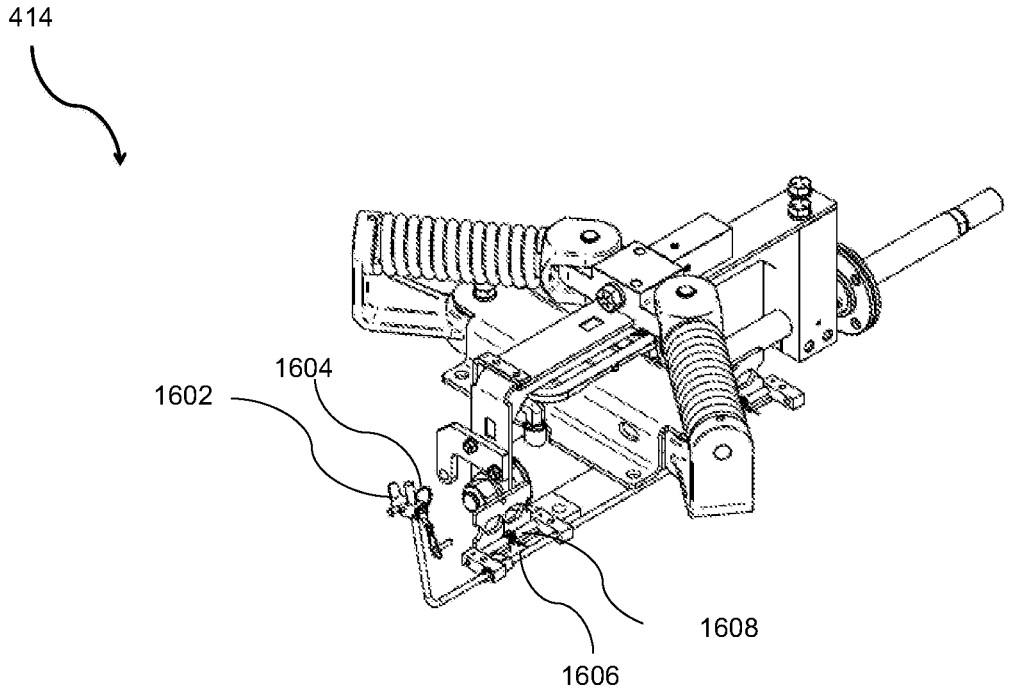
FIG. 16 illustrate the various operations of the rotation limit ring, in accordance with at least one embodiment.

FIG. 16 illustrates the center stroke unit 414, in accordance with at least one embodiment. The center stroke unit includes a control shaft 1602, having plurality of modes, wherein the modes including center stroke unit 414 in disengaged and locked position mode, and the center stroke unit 414 in engaged position mode; a safety latch 1604 to lock the operation shaft at the disengaged and locked position mode; and at least two separated centering block 1606, 608 to limit the cylindrical movement in each direction. In addition, centering block operates regardless the position of the switch.

Figure 17:
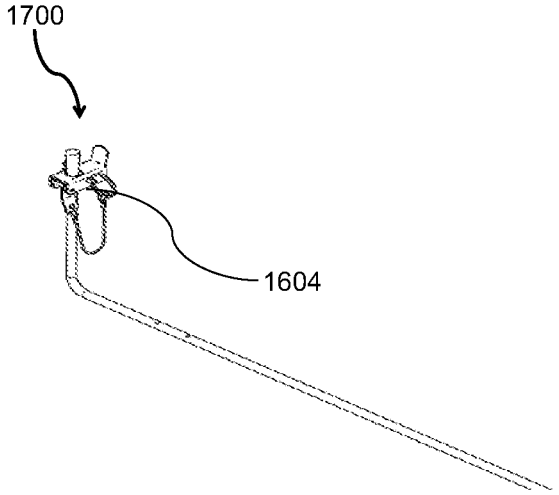
FIG. 17 illustrates the center stroke unit, in accordance with at least one embodiment.
Figure 18:
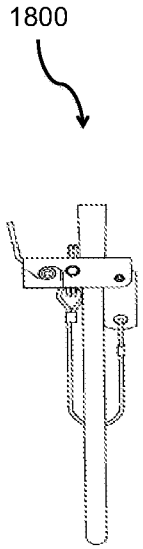
FIG. 18 illustrates the various operations of a shaft, in accordance with at least one embodiment.
Figure 19:
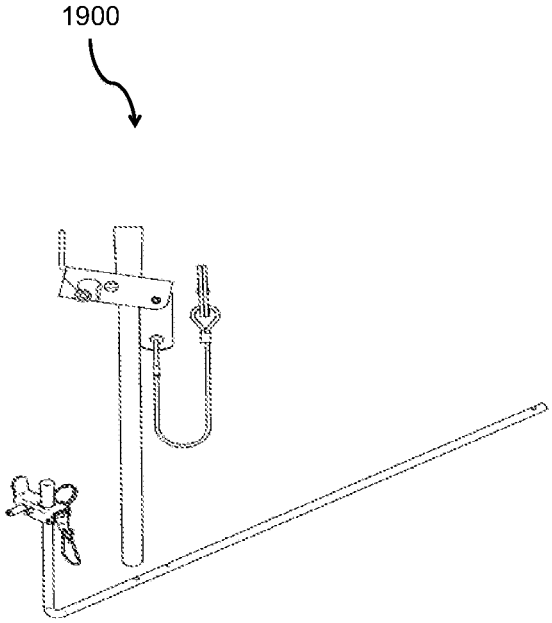
FIG. 19 illustrates the various operations of a shaft, in accordance with at least one embodiment.

FIGS. 17-19 illustrate the various operations of shaft, in accordance with at least one embodiment. The secure latch is designed to maintain the centering operation shaft at the desired position. To unlock the shaft, it is necessary to remove the lock pin with lanyard from the lock tab. Furthermore, the lock tab is released from the lock pin installed at the rear panel of the switch housing and the centering position shaft is rotated to the rest position (limit pin).

Figure 20:
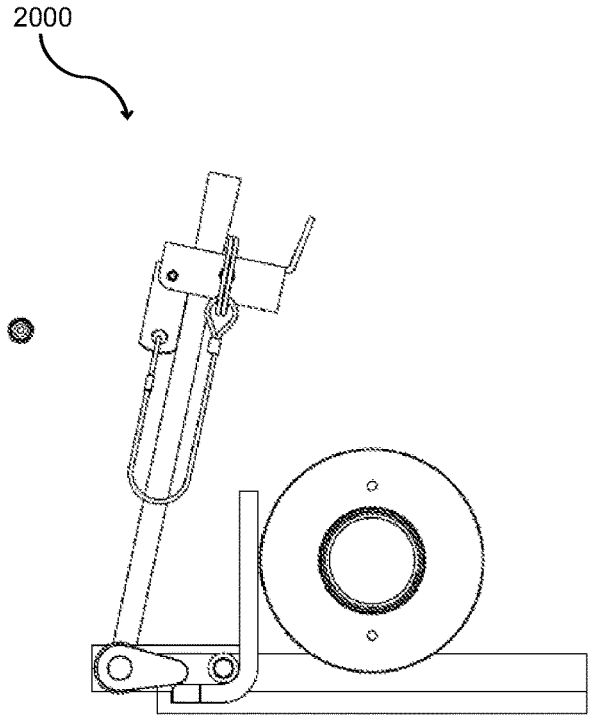
FIG. 20 illustrates the various operations of a shaft, in accordance with at least one embodiment.
Figure 21:
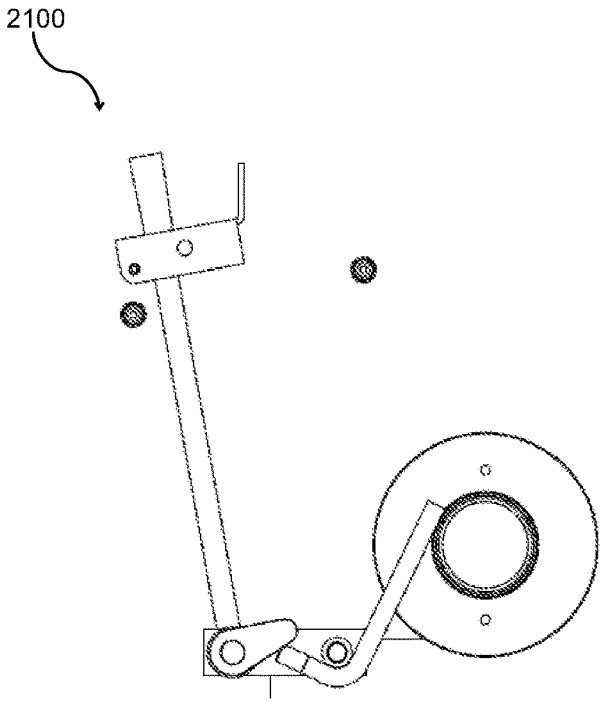
FIG. 21 illustrates the various operations of a shaft, in accordance with at least one embodiment.
Figure 22:
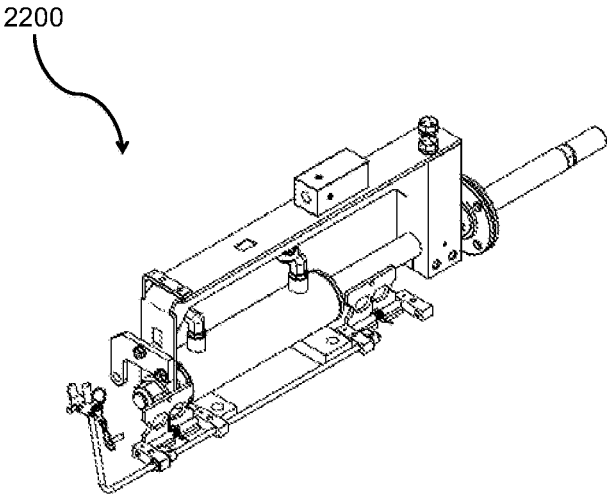
FIG. 22 illustrates the shaft in locked and unlocked positions, in accordance with at least one embodiment.
Figure 23:
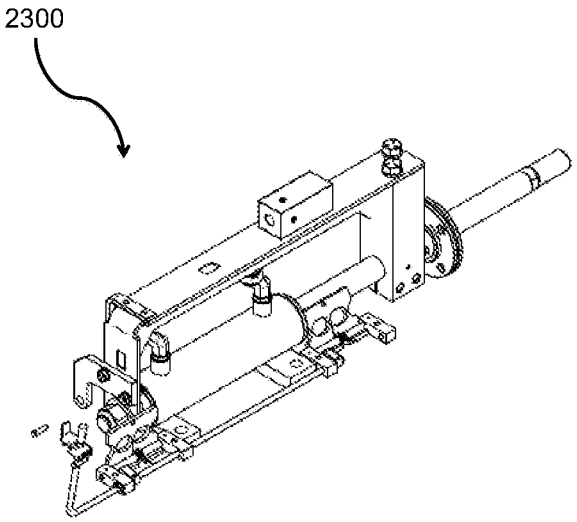
FIG. 23 illustrates the shaft in locked and unlocked positions, in accordance with at least one embodiment.
Figure 24:
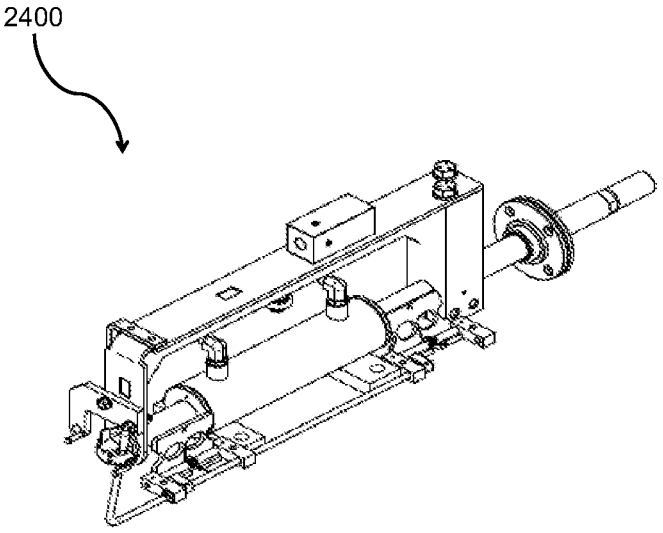
FIG. 24 illustrates the center stroke unit in locked and unlocked positions, in accordance with at least one embodiment.
Figure 25:
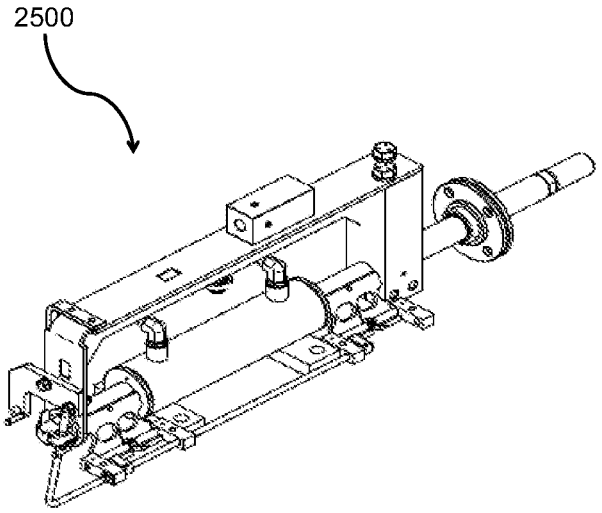
FIG. 25 illustrates the center stroke unit in locked and unlocked positions, in accordance with at least one embodiment.

FIGS. 20 and 21 illustrate the shaft in locked 2000 and unlocked 2100 positions, in accordance with at least one embodiment. When the centering operation shaft is unlocked, the two cams installed at the shaft will release the centering blocks. Each centering block has a torsion spring to move each one against the cylinder block to stop the cylinder movement at the middle stroke distance.

FIGS. 22-25 illustrate the center stroke unit in locked and unlocked positions, in accordance with at least one embodiment. When the centering operation shaft is locked 2200, the two center blocks are kept upright, allowing the cylinder to move freely from reverse to forward position and vice versa. When the shaft is unlocked 2300 and moved to the rest position (limit pin), both center blocks are released to move and block the cylinder movement. One center block is pivoted completely toward the cylinder rod and the other is blocked by the top rod bracket or front rod bar. If a user operates the switch manually (hand throw operation), the cylinder will stop at the middle stroke blocked by the center block. When the cylinder reaches the middle stroke, the second center block will be also be pivoted, locking the cylinder movement in any direction.

The switch rod may remain at the middle stroke until the center blocks are returned to the upright position, the center operation shaft is locked, and the lock pin is in place. The lock pin is a redundant safety measure to guarantee the center shaft is not released under a strong vibration situation.

Figure 26:
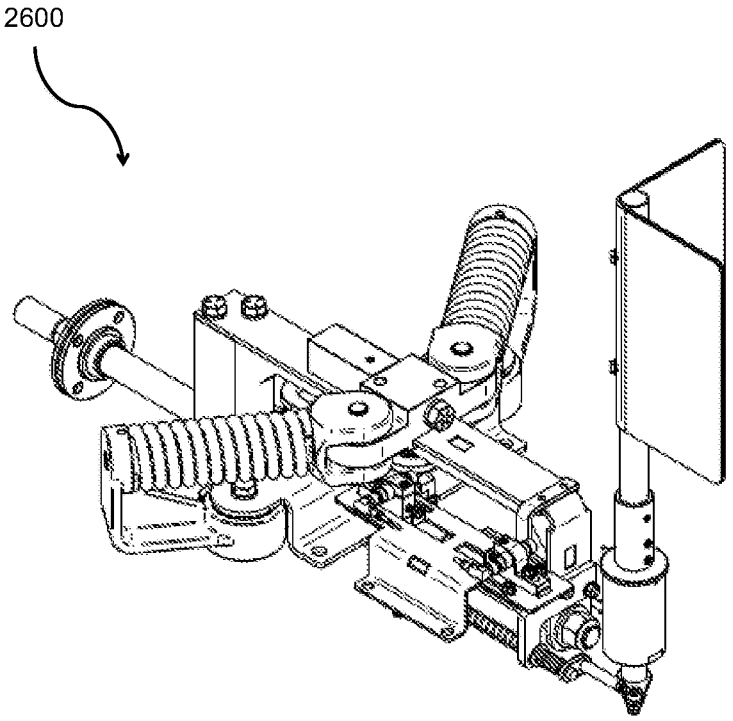
FIG. 26 illustrates the center stroke unit in locked and unlocked positions, in accordance with at least one embodiment.

FIG. 26 illustrates the switch point detection through proximity sensors 412, in accordance with at least one embodiment. The plurality of proximity sensors 412 are installed in parallel to the switch rod. A sensor target installed at the top rod bracket activates each proximity sensor at the desired reverse and forward positions.

Figure 27:
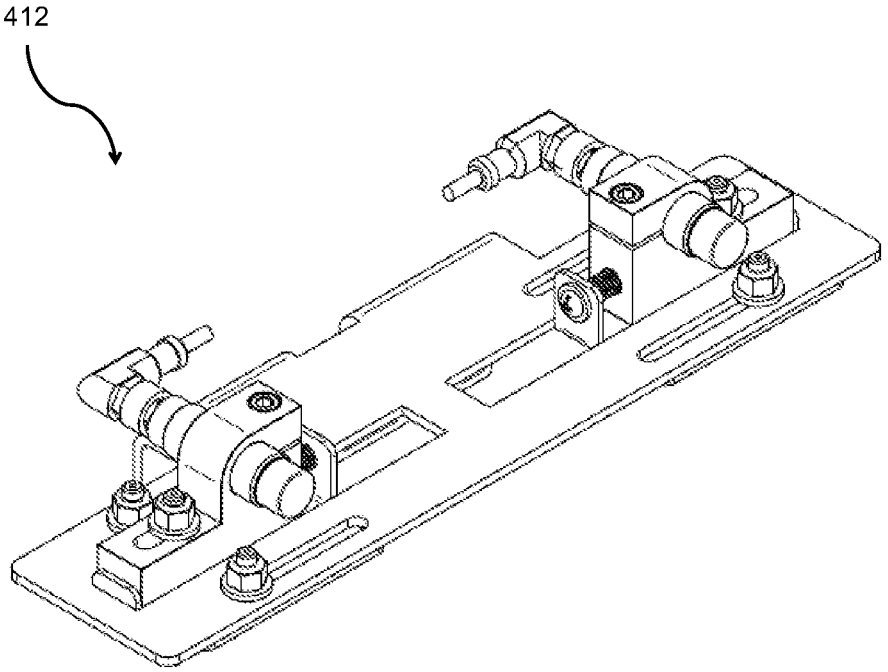
FIG. 27 illustrates the center stroke unit in locked and unlocked positions, in accordance with at least one embodiment.

FIG. 27 illustrates the plurality of proximity sensors 412, in accordance with at least one embodiment. A block clamp holds the plurality of proximity sensors in position. During the installation, each sensor bracket is released to move the sensor block to the sensor activation position. The switch point opening must be adjusted to allow a small opening without a false opening alarm. That limit position can be reached using the fine adjustment bolt.

The present hydraulic railroad switch device provides a reliable switch point detection and enables a hand throw operation without electric power energy. Furthermore, the present presents an effective solution for avoiding the switch from moving due to the spring force generated during manual installation or maintenance.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms enclosed. On the contrary, the intention is to cover all modifications, alternative constructions, and equivalents falling within the spirit and scope of the invention, as defined in the appended claims. Thus, it is intended that the present invention covers the modifications and variations of this invention, provided they are within the scope of the appended claims and their equivalents.

What is claimed is:

1. A railroad switch device for moving railroad switch points, the device comprising:

a hydraulic unit comprising:

a hydraulic manifold;

a hydraulic cylinder to provide constant forward movement and reverse movement, and a hydraulic circuit unit;

a mechanical target to automatically indicate the position of a point rod, wherein the hydraulic unit is coupled to the point rod;

a plurality of spring units to produce a continuous thrust force for holding the railroad switch points closed in forward position and reverse position, wherein the plurality of spring units control the target rotation to 90 degrees through a bolt configured with a rotation limit ring;

a plurality of proximity sensors to detect the point rod position; and a power unit to supply the hydraulic power to the hydraulic unit for moving the hydraulic cylinder.

2. The device according to claim 1 is operated by at least one of the plurality of electrical commands, and manually.

3. The device according to claim 1 the power unit can be a DC battery source, an AC power source, or combination thereof.

4. The device according to claim 1 further comprising: a top rod bracket, a center bracket, and a cam follower bearing, wherein the cam follower bearing installed under the top rod bracket runs inside a centering bracket roller tray to avoid the rod rotation caused by external forces.

5. The device according to claim 1 wherein the hydraulic manifold includes a hand throw pump to move a switch rod during installation and also move without power.

6. The device according to claim 1 further includes a block clamp to hold the plurality of proximity sensors in position.

7. The device according to claim 1 wherein the center stroke unit comprising: a control shaft having plurality of modes, wherein the modes, including center stroke unit, are in disengaged and locked position mode, and the center stroke unit is in engaged position mode; a safety latch, locking the operation shaft in a disengaged and locked position mode; and at least two separated centering block to limit the cylindrical movement in each direction.

8. The device according to claim 1 wherein the plurality of proximity sensors are installed in parallel to the switch rod.

9. The device according to claim 1 further includes a sensor target installed upon a top rod bracket to activate each proximity sensor at the desired reverse position and forward position.

10. The device according to claim 1 further comprising: a front flange; and bushing to avoid the rod to bend under the stress caused by the train running through a track coupled to the device.

11. The device according to claim 1 further comprising: a hand throw socket to manually pump hydraulic oil for moving the hydraulic cylinder in the forward position and the reverse position.

* * * * *